US008802879B2

(12) United States Patent
Kumar et al.

(10) Patent No.: US 8,802,879 B2
(45) Date of Patent: Aug. 12, 2014

(54) PROCESS FOR REMOVAL OF METALS FROM OILS/FATS

(75) Inventors: Sarvesh Kumar, Faridabad (IN); Ravi B. Kumar, Faridabad (IN); Alok Sharma, Faridabad (IN); Brijesh Kumar, Faridabad (IN); Surbhi Semwal, Faridabad (IN); Ajay Kumar Arora, Faridabad (IN); Suresh Kumar Puri, Faridabad (IN); Saeed Ahmed, Faridabad (IN); Vivekanand Kagdiyal, Faridabad (IN); Santanam Rajagopal, Faridabad (IN); Ravinder Kumar Malhotra, Faridabad (IN); Anand Kumar, Faridabad (IN)

(73) Assignee: Indian Oil Corporation Ltd., Kolkata (IN)

( * ) Notice: Subject to any disclaimer, the term of this patent is extended or adjusted under 35 U.S.C. 154(b) by 0 days.

(21) Appl. No.: 13/808,798

(22) PCT Filed: Jul. 4, 2011

(86) PCT No.: PCT/IN2011/000446
§ 371 (c)(1),
(2), (4) Date: Mar. 21, 2013

(87) PCT Pub. No.: WO2012/004810
PCT Pub. Date: Jan. 12, 2012

(65) Prior Publication Data

US 2013/0197251 A1 Aug. 1, 2013

(30) Foreign Application Priority Data

Jul. 8, 2010 (IN) ..... 750/KOL/2010

(51) Int. Cl.
*C11B 3/00* (2006.01)
*C11B 3/04* (2006.01)
*C11B 3/10* (2006.01)

(52) U.S. Cl.
CPC . *C11B 3/001* (2013.01); *C11B 3/04* (2013.01); *C11B 3/10* (2013.01)
USPC ..... 554/191; 554/204

(58) Field of Classification Search
CPC ..... C11B 3/00; C11B 3/001; C11B 3/006; C11B 3/04; C11B 3/10; C11B 3/12; C11B 3/14
USPC ..... 554/191, 204
See application file for complete search history.

(56) References Cited

U.S. PATENT DOCUMENTS 6,407,271 B1 6/2002 Deffense
2003/0050492 A1 * 3/2003 Copeland et al. ..... 554/204

FOREIGN PATENT DOCUMENTS

GB 1 580 664 A 12/1980
WO 2009/131510 A1 10/2009
WO WO 2009131510 A1 * 10/2009 ..... C11C 3/12

OTHER PUBLICATIONS

International Search Report of PCT/IN2011/000446 dated Oct. 6, 2011.

*Primary Examiner* — Deborah D Carr
(74) *Attorney, Agent, or Firm* — Maschoff Brennan

(57) ABSTRACT

The invention describes process for demetallation of vegetable oils and animal fats to reduce metal content below 1 ppm to make them suitable for hydroprocessing feedstocks. The process comprises acid treatment with very low concentration of acids, utilizing synergistic effect of phosphoric acid and citric acid, followed by counter-current treatment with clay without intermediate step of water washing and treatment with ion exchange resin.

25 Claims, 1 Drawing Sheet

HT = Heater, CSTR = Continuous Stirrer Tank Reactor, HCS = Hydro cyclone Separator, FP = Filter Press, IER= Ion Exchange Resin

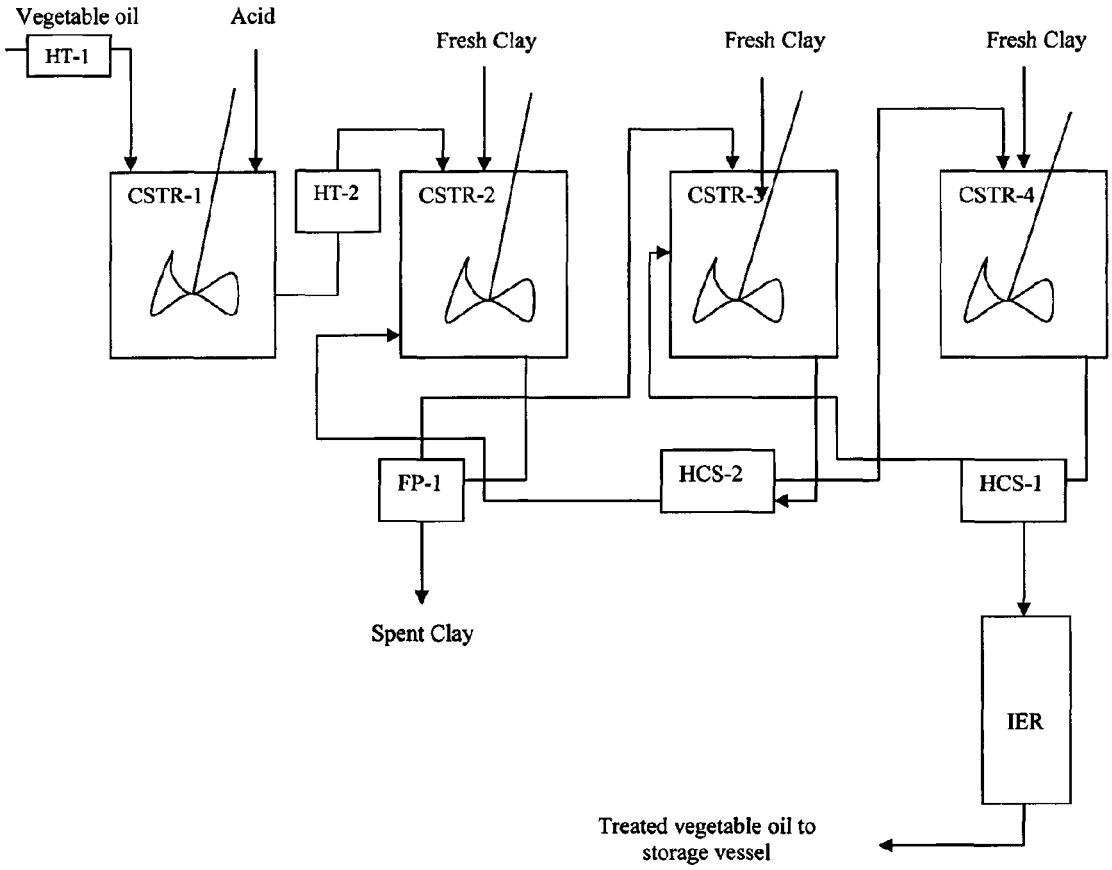
HT = Heater, CSTR = Continuous Stirrer Tank Reactor, HCS = Hydro cyclone Separator, FP = Filter Press, IER= Ion Exchange Resin

PROCESS FOR REMOVAL OF METALS FROM OILS/FATS

CROSS REFERENCE TO RELATED APPLICATIONS

This application is a National Stage of International Application No. PCT/IN2011/000446 filed Jul. 4, 2011, claiming priority based on India Patent Application No. 750/KOL/2010, filed Jul. 8, 2010, the contents of all of which are incorporated herein by reference in their entirety.

FIELD OF THE INVENTION

The present invention relates to a process for removal of metals in oils/fats. This invention particularly relates to a process to reduce metals from oils/fats preferably from vegetable oils/animal oils/fats. It reduces the total metal content sufficiently below 1 ppm in order to make them suitable for hydroprocessing/Fluid Catalytic Cracking (FCC) feedstocks.

BACKGROUND OF THE INVENTION AND PRIOR ART

This invention relates to a process for demetallation in oils/fats most preferably vegetable oils/animal oils/fats. The metal mainly includes P, Na, K, Ca, Mg, Cu, Fe etc. The present invention is an environment friendly, industrial effluent free novel process, which includes avoidance of any water washing process during counter-current treatment with recycled and fresh clay in one or more stages. The inventive process also avoids usage of any expensive industrial chemicals that are used in prior art. The process finally includes treatment of oils/fats with ion exchange resin to make the oils/fats suitable for feedstocks for catalytic refining processes, such as hydroprocessing/FCC. The present invention increases the shelf life of the oils/fats by reducing total metal contaminant below 1 ppm. Thereby the present invention provides a very cost effective process to produce total metal contaminant free oils/fats.

Conventionally, biodiesel is produced by transesterification of vegetable oil, which are triglycerides of $C_{14}$ to $C_{22}$ straight-chain unsaturated carboxylic acids. In the process, triglycerides are converted into Fatty Acid Methyl Esters (FAME) with an alcohol in the presence of a catalyst. The process though simple suffers from several disadvantages. The removal of glycerin needs separation, excess of methanol is necessary to complete the reaction and subsequently its recovery. There are steps of water washing to remove the caustic and this adds to the plant effluent. Moreover if the vegetable oil is rancid, an additional step of esterification is necessary. The process is suitable only for oils having low Free Fatty Acid (FFA) <0.5%.

Biodiesel has several inherent problems such as high density of about 0.88 g/cc (diesel density 0.825 to 0.845 g/cc) and narrow boiling range 340° C.+. Any further reduction in T-95 specification will affect refiner's profitability adversely due to requirement of production of lighter diesel for enabling blending of biodiesel. The presence of oxygen in biodiesel also results in higher emissions of NOx. Also, FAME is not well accepted by auto industry in all proportions as these are responsible for injector coking.

To overcome the above difficulties, Refiners are exploring hydroprocessing route, as an alternative option, and produce renewable fuels such as diesel, ATF, gasoline etc from vegetable oils/animal oils/fats. This will enable integrated refining and marketing companies to meet stipulation of blending biofuels in diesel that may be mandated by the Government in near future. The process results in improvement in quality of diesel particularly w.r.t. cetane number and density. The process is capable of handling different vegetable oils; however, it is required to pre-treat the oil to remove metals below 1 ppm to avoid faster catalyst deactivation.

Vegetable oils and animal oils/fats typically contain about 50-800 ppm of metals such as P, Na, K, Ca, Mg, Cu, Fe etc. In crude vegetable oil, these metals can originate from contamination by soil and fertilizers. The phosphorous is present as phosphorous based compounds (phosphatides). The presences of these compounds impart undesirable flavor, color, and shorten the shelf life of oil.

Metals such as Fe and Cu are usually resulted from corrosion and mechanical wear at the mills and refineries. These metals are prooxidant and thus, detrimental to the oil quality. Trace metals may be present as complexes surrounded by proteins, phospholipids and lipids or non-lipid carriers. These metals catalyze the compositions of hydroperoxides to free radicals. Fe increases the rate of peroxide formation while Cu accelerates the hydroperoxides destruction rate thereby increasing the production of secondary oxidation products.

Conventionally, water acid degumming is used to remove phosphatides from vegetable oils and animal oils/fats. This process is being used as part of biodiesel manufacturing plant. In this process oil is heated up to about 70-90° C. followed by mixing of 0.05 to 0.1% phosphoric acid in a Continuous Stirrer Tank Reactor (CSTR). The residual acid is neutralized in subsequent CSTR by mixing with caustic followed by removal of gums by centrifugation and water washing. The process requires huge quantity of water for water washing and its disposal. Caustic used for neutralization of residual phosphoric acid also reacts with free fatty acids present in oils and fats and forms stable emulsion which is very difficult to break and requires longer time. The process is not suitable for removal of trace metals below 20 ppm.

U.S. Pat. No. 5,239,096 disclosed a process for reducing non-hydratable gums and wax content in edible oils. The process involves mixing with 0.01 to 0.08% acid (in the form 10-15% aqueous solution), adding 1-5% base solution followed by slow mixing for 1-4 hrs, separating gums and water washing of oil. As discussed above the process will suffer due to drawbacks of water washing and neutralization steps.

U.S. Pat. No. 6,407,271 disclosed a method for eliminating metals from fatty acid substances and gum associated with said metals. Method comprises mixing of vegetable oil with aqueous solution of salt of polycarboxylic acid (Sodium salt of ethylenediaminetetraacetic acid, EDTA) in the droplets or micelles in the weight ratio above 3. The aqueous phase is separated from oil by centrifuging or ultra filtration. Process uses very expensive chemicals and huge quantity of water about 33% of vegetable oil.

U.S. Pat. No. 6,844,458 disclosed improved refining method for vegetable oils. In this method aqueous organic acid and oil subjected to high and low shear followed by centrifuge to remove gums. As cited in examples process uses about 10% water of oil quantity to dilute the acid solution and treated oil still contain about 20 ppm of metals.

U.S. Pat. No. 7,494,676 disclosed a pretreatment process comprising of a) enzymatic degumming with or without citric acid and sodium hydroxide b) bleaching with 2-4%) bleaching earth and 0-1% activated carbon c) dewaxing at low temperature of 18-20° C. with gentle stirring for about 12-18 hrs to achieve <5 ppm phosphorous. The process uses up to 2.5% of water and centrifuge for separation of gums. As described above, caustic react with free fatty acids present in oil and fats and forms stable emulsion which is very difficult to break and require longer time. The complete process takes very long time of about 15-20 hrs. Hence the size of dewaxing vessel will be huge and also require high energy for stirring. Moreover, process did not discuss the removal of other metals such as Fe, Cu, Na, K, Ca, Mg etc. present in the oil.

Hence, there is need of simple and suitable process which can avoid use of water and expensive chemicals and reduce total metal contaminant below 1 ppm to make the oil or fat suitable for catalytic processes such as hydro processing/fluid catalytic cracking.

There is also a need to provide a demetallation process suitable for removal of total metals below 1 ppm in vegetable oils such as jatropha carcass oil, karanj oil, castor oil, ricebran oil, soybean oil, sunflower oil, palm oil, rapeseed oil etc and animal oil/fats such as fish oil, lard etc. Further, avoidance of water washing makes the process environment friendly and effluent free. Likewise, centrifuging steps in the process need to be avoided.

SUMMARY OF THE INVENTION

The present invention provides a simple and cost effective demetallation process for removal of total metals below 1 ppm from vegetable oils/animal oils/fats by avoiding usage of water washing and centrifuging steps. Since the present invention avoids water washing, it makes the process environment friendly and effluent free. The synergistic effect due to simultaneous usage of phosphoric and citric acid enhances the performances and reduces total quantity of the acids required in comparison to any individual acid. The clay used in the present invention is recycled by way of counter current recycling to minimize the total consumption of the clay. The advantage in the present invention is achieved by recycling of the clay from subsequent stage to the previous stage and charging the final stage with fresh clay. Finally, the oil is treated with ion exchange resin to reduce total metals below 1 ppm. The invention does not involve the use of water washing and centrifuging steps in this process.

BRIEF DESCRIPTION OF THE ACCOMPANYING DRAWING

The above and/or other aspects of the present invention will be made more apparent by describing certain exemplary embodiments of the present invention with reference to the accompanying drawings, in which:

FIG. 1 shows an exemplary process flow schematic embodying the disclosed techniques.

DETAIL DESCRIPTION OF THE INVENTION

The present invention provides an environment friendly process for removal of total metals below 1 ppm in vegetable oils/animal oils/fats. Phosphoric acid and citric acid are simultaneously used so that their synergistic effect reduces the requirement of the said acids. The process is conducted without involvement of water washing step, making the process effluent free. It reduces the consumption of clay by recycling.

The mixture of phosphoric acid and citric acid has a synergistic effect which reduces the acid requirement. The proportion of these acids required for the process is very low and ranges from 0.01 to 0.10 wt %. Preferred proportion for phosphoric acid is 0.02 to 0.08 wt % and more preferred proportion is 0.03 to 0.05 wt % with respect to the oils/fats used; corresponding proportions of citric acid is 0.01 to 0.10 wt %, preferred proportion is 0.02 to 0.08 wt % and more preferred proportion is 0.02 to 0.04 wt %. The process is carried out at a temperature of 40-100° C. under constant agitation. The proportion of clay used ranges from 0.5 to 5 wt % and the temperature of the clay ranges from 80-100° C. for 30-90 minutes under stirring after acid mixing. The clay treatment is preferably done in multiple stages with fresh clay and/or recycled clay in counter-current movement. The fresh clay can be added in all stages of clay treatment and spent clay is withdrawn from each stage of clay treatment or fresh clay is added in the last stage of clay treatment and spent clay is withdrawn from first stage of clay treatment. The recycled clay is separated by employing hydrocyclone separator. Spent clay is separated by employing filter press. For bringing down the metal content even below 1 ppm according to this invention the acid and clay treated oils/fats are required to be finally treated with ion exchange resin. The ion exchange resin is selected from one or more of styrene, crosslinked polystyrene, crosslinked polyacrylic crosslinked polymethacrylic resin etc. These resins can be commercially available and are in the form of gel, macro porous or isoporous etc. The said ion exchange resin treatment is carried out using two beds of ion exchange resin operated in swing mode of demetallation and regeneration. The regeneration of the ion exchange resin is carried out by circulation of an alcohol like isopsopropyl alcohol and dilute solution of an inorganic acid like HCl.

The oils/fats can be selected preferably from the vegetable and/or animal sources. The edible and non-edible vegetable oil is preferably selected from one or more of jatropha carcass oil, karanj oil, castor oil, ricebran oil, soybean oil, sunflower oil, palm oil, rapeseed oil etc. The animal oil/fat is preferably selected from one or more of fish oil, lard etc. There is no need of any water washing of treated oils/fats in the process. The metal contaminants can be one or more of P, Na, K, Ca, Mg, Cu, Zn, Mn, Fe and the like.

It has been surprisingly found in the process that simultaneous use of phosphoric and citric acids reduces total quantity of the acids required in comparison to any individual acid. It has been also found in the process that the used clay can be recycled, hence its total consumption is minimized. Further, it has been found that use of ion exchange resin reduces total metal below 1 ppm.

The invention is now more specifically described with the help of a schematic demetallation process flow scheme shown in FIG. 1. In this process vegetable oil is heated up to 50-60° C. and sent to CSTR-1, where 0.02 to 0.05% phosphoric, citric or both acids are added and temperature raised up to 80-100° C. and mixed for 30 to 60 minutes with gentle stirring. After completion of mixing in CSTR-1, the mixture is sent to CSTR-2, maintained at 80-100° C., where fresh or recycle clay from CSTR-3 is continuously added under mixing for 30 to 60 minutes. After completion of mixing in CSTR-2, the mixture of clay and oil is separated employing a filter press. The spent clay withdrawn from filter press is sent for disposal after recovery of gums and oil. The oil from filter press is sent to CSTR-3, maintained at 80-100° C., where fresh or recycle clay from CSTR-4 is continuously added under mixing for 30 to 60 minutes. After completion of mixing in CSTR-3, the mixture of clay and oil is separated employing a hydrocyclone separator. The recycle clay withdrawn from hydrocyclone separator is sent to CSTR-2 and oil is sent to CSTR-4. In CSTR-4 fresh clay in the range from 0.5 to 3.0 wt % of oil is added and mixing continued for 30-120 minutes. After completion of mixing in CSTR-4, the mixture of clay and oil is separated employing a hydrocyclone separator. The recycle clay withdrawn from hydrocyclone separator is sent to CSTR-3 and treated oil containing below 5 ppm metal is sent to ion exchange resin to reduce metal below 1 ppm. In the similar fashion more than 3 stages of clay mixing may be employed. The process avoids use of water washing, minimizes total acid consumption and also reduces use of clay with recycling.

EXAMPLES

Example-1

200 gm jatropha carcass oil containing 413 ppm of metals was heated up to 50° C. followed by mixing of 0.2 gm phosphoric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-1.

TABLE 1

| | Metal content in ppm | |
|---|---|---|
| Metal | *Jatropha* carcass oil | Treated *Jatropha* carcass oil |
| P | 175 | 14 |
| Na | 5 | 3 |
| Ca | 91 | 15 |
| Mg | 82 | 11 |
| Fe | 57 | 6 |
| Cu | — | — |
| K | — | — |
| Zn | — | — |
| Mn | 3 | — |
| Total | 413 | 49 |

Example-2

200 gm jatropha carcass oil containing 413 ppm of metals was heated up to 50° C. followed by mixing of 0.1 gm phosphoric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-2.

TABLE 2

| | Metal content in ppm | |
|---|---|---|
| Metal | *Jatropha* carcass oil | Treated *Jatropha* carcass oil |
| P | 175 | 24 |
| Na | 5 | 3 |
| Ca | 91 | 4 |
| Mg | 82 | 6 |
| Fe | 57 | — |
| Cu | — | — |
| K | — | — |
| Zn | — | 1 |
| Mn | 3 | — |
| Total | 413 | 38 |

Example-3

200 gm jatropha carcass oil containing 413 ppm of metals was heated up to 50° C. followed by mixing of 0.2 gm citric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-3.

TABLE 3

| | Metal content in ppm | |
|---|---|---|
| Metal | *Jatropha* carcass oil | Treated *Jatropha* carcass oil |
| P | 175 | 10 |
| Na | 5 | 2 |
| Ca | 91 | 6 |
| Mg | 82 | 3 |
| Fe | 57 | 5 |
| Cu | — | — |
| K | — | — |
| Zn | — | — |
| Mn | 3 | — |
| Total | 413 | 32 |

Example-4

200 gm jatropha carcass oil containing 413 ppm of metals was heated up to 50° C. followed by mixing of 0.1 gm citric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-4.

TABLE 4

| | Metal content in ppm | |
|---|---|---|
| Metal | *Jatropha* carcass oil | Treated *Jatropha* carcass oil |
| P | 175 | 18 |
| Na | 5 | — |
| Ca | 91 | 14 |
| Mg | 82 | 5 |
| Fe | 57 | 8 |
| Cu | — | — |
| K | — | — |
| Zn | — | — |
| Mn | 3 | — |
| Total | 413 | 45 |

Example-5

200 gm Jatropha carcass oil containing 413 ppm of metals was heated up to 50° C. followed by mixing of 0.1 gm each of phosphoric acid and citric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-5.

TABLE 5

| Metal | Metal content in ppm | |
|---|---|---|
| | *Jatropha* carcass oil | Treated *Jatropha* carcass oil |
| P | 175 | 1 |
| Na | 5 | 4 |
| Ca | 91 | 1 |
| Mg | 82 | — |
| Fe | 57 | — |
| Cu | — | — |
| K | — | — |
| Zn | — | — |
| Mn | 3 | — |
| Total | 413 | 6 |

Example-6

200 gm jatropha carcass oil containing 413 ppm of metals was heated up to 50° C. followed by mixing 0.10 gm phosphoric acid and 0.04 gm of citric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-6.

TABLE 6

| Metal | Metal content in ppm | |
|---|---|---|
| | *Jatropha* carcass oil | Treated *Jatropha* carcass oil |
| P | 175 | 2 |
| Na | 5 | — |
| Ca | 91 | 1 |
| Mg | 82 | — |
| Fe | 57 | — |
| Cu | — | — |
| K | — | — |
| Zn | — | — |
| Mn | 3 | — |
| Total | 413 | 3 |

Example-7

200 gm jatropha carcass oil containing 413 ppm of metals was heated up to 50° C. followed by mixing 0.10 gm phosphoric acid and 0.02 gm of citric acid. The temperature is increased to 90° C. and the mixing was continued for 60 minutes. Then 10 gm of clay is added with stirring and maintained at 90° C. for 90 minutes. The reaction mixture is filtered and again the clay treatment is performed with another 10 gm of clay. The metals content of raw jatropha carcass oil and treated oil is given below in Table-7.

TABLE 7

| Metal | Metal content in ppm | |
|---|---|---|
| | *Jatropha* carcass oil | Treated *Jatropha* carcass oil |
| P | 175 | 4 |
| Na | 5 | — |
| Ca | 91 | 2 |
| Mg | 82 | 1 |
| Fe | 57 | 3 |

TABLE 7-continued

| Metal | Metal content in ppm | |
|---|---|---|
| | *Jatropha* carcass oil | Treated *Jatropha* carcass oil |
| Cu | — | — |
| K | — | — |
| Zn | — | — |
| Mn | 3 | — |
| Total | 413 | 10 |

Example-8

200 gm jatropha carcass oil containing 413 ppm of metals was heated up to 50° C. followed by mixing 0.10 gm phosphoric acid and 0.04 gm of citric acid. The temperature is increased to 90° C. and the mixing was continued for 60 minutes. Then 6 gm of clay is added with stirring and maintained at 90° C. for 90 minutes. The reaction mixture is filtered and again the clay treatment was performed twice with 6 gm of clay in each step. The metals content of raw jatropha carcass oil and treated oil is given below in Table-8.

TABLE 8

| Metal | Metal content in ppm | | |
|---|---|---|---|
| | Treated *Jatropha* carcass oil after first stage | Treated *Jatropha* carcass oil after second stage | Treated *Jatropha* carcass oil after third stage |
| P | 37 | 5 | 1 |
| Na | 4 | 5 | — |
| Ca | 13 | 3 | 1 |
| Mg | 10 | 6 | — |
| Fe | 22 | 2 | 1 |
| Cu | — | — | — |
| K | — | — | — |
| Zn | 2 | — | — |
| Mn | 1 | — | — |
| Total | 89 | 20 | 3 |

Example-9

200 gm jatropha carcass oil containing 413 ppm of metals was heated up to 50° C. followed by mixing 0.10 gm phosphoric acid and 0.04 gm of citric acid. The temperature is increased to 90° C. and the mixing was continued for 60 minutes. Then recycled clay separated from second stage of previous experiment was added with stirring and maintained at 90° C. for 90 minutes. The reaction mixture is filtered and again treated with recycled clay separated from third stage of previous experiment. The filtered product was treated with 6 gm of fresh clay.

The metal content after treatment is given below in Table-9. It is evident from these examples that use of fresh clay has been minimized by one third by recycling of clay in counter current manner

TABLE 9

| Metal | Metal content in ppm | | |
|---|---|---|---|
| | Treated *Jatropha* carcass oil after first stage | Treated *Jatropha* carcass oil after second stage | Treated *Jatropha* carcass oil after third stage |
| P | 37 | 5 | 1 |
| Na | 4 | 5 | — |
| Ca | 13 | 3 | 1 |
| Mg | 10 | 6 | — |
| Fe | 22 | 2 | 1 |
| Cu | — | — | — |
| K | — | — | — |
| Zn | 2 | — | — |
| Mn | 1 | — | — |
| Total | 89 | 20 | 3 |

Example-10

200 gm jatropha carcass oil containing 413 ppm of metals was heated up to 50° C. followed by mixing 0.10 gm phosphoric acid and 0.04 gm of citric acid. The temperature is increased to 90° C. and the mixing was continued for 60 minutes. Then recycled clay separated from second stage of previous experiment was added with stirring and maintained at 90° C. for 90 minutes. The reaction mixture is filtered and again treated with recycled clay separated from third stage of previous experiment. The filtered product was treated with 6 gm of fresh clay.

The treated oil from third stage of clay treatment is sent to ion exchange resin to reduce metal below 1 ppm. The metal content after treatment is of is given below in Table-10.

TABLE 10

| Metal | Metal content in ppm | | | |
|---|---|---|---|---|
| | Treated *Jatropha* carcass oil after first stage | Treated *Jatropha* carcass oil after second stage | Treated *Jatropha* carcass oil after third stage | Treated oil after Ion Exchange Resin |
| P | 37 | 5 | 1 | — |
| Na | 4 | 5 | — | — |
| Ca | 13 | 3 | 1 | — |
| Mg | 10 | 6 | — | — |
| Fe | 22 | 2 | 1 | — |
| Cu | — | — | — | — |
| K | — | — | — | — |
| Zn | 2 | — | — | — |
| Mn | 1 | — | — | — |
| Total | 89 | 20 | 3 | — |

Having described the invention in detail with particular reference to the illustrative examples given above and the accompanying drawings, it will now be more specifically defined by means of claims appended hereafter.

The invention claimed is:

1. An environment friendly process for removal of total metals below 1 ppm in vegetable oils/animal oils/fats, said process comprising:

treating a feed comprising vegetable oils/animal oils/fats with phosphoric acid and citric acid to obtain a reaction mixture; and treating the reaction mixture with clay in one or more stages, wherein:

an amount of phosphoric acid used is in the range of 0.01 to 0.10 wt % and an amount of citric acid used is in the range of 0.01 to 0.10 wt %, the wt % being with respect to the vegetable oils/animal oils/fats, so that their synergistic effect enhances the performance and reduces the requirement of the said acids and clay; and the process is conducted without a water washing step, making the process effluent free.

2. The process as claimed in claim 1, wherein:

an amount of the clay used is in the range of 0.5 to 5.0 wt % with respect to the vegetable oils/animal oils/fats; and treating the reaction mixture is performed at the a temperature range from 80-100° C. for 30-90 minutes under stirring.

3. The process as claimed in claim 1, wherein an amount of phosphoric acid used is in the range of 0.02 to 0.08 wt % with respect to the vegetable oils/animal oils/fats.

4. The process as claimed in claim 1, wherein an amount of citric acid used is in the range of 0.02 to 0.08 wt % with respect the vegetable oils/animal oils/fats.

5. The process as claimed in claim 1, wherein both phosphoric acid and citric acid are used simultaneously, and their proportions range from 0.01 to 0.10 wt % each with respect to the vegetable oils/animal oils/fats.

6. The process as claimed in claim 1, wherein treating the feed with the phosphoric acid and the citric acid is carried out at a temperature of 40-100° C. under constant agitation.

7. The process as claimed in claim 1, wherein the reaction mixture is treated with 0.5 to 5 wt % of clay at a temperature range of 80-100° C., the wt % being with respect to the vegetable oils/animal oils/fats.

8. The process as claimed in claim 1, wherein the clay is used in multiple stages with fresh clay and/or recycled clay.

9. The process as claimed in claim 1, wherein the treating the reaction mixture with clay is carried out in counter-current movement.

10. The process as claimed in claim 8, wherein the fresh clay is added in the last of the multiple stages.

11. The process as claimed in claim 8, wherein the fresh clay is added in all of the multiple stages, and spent clay is withdrawn from each of the multiple stages.

12. The process as claimed in claim 8, wherein recycled clay is separated by employing a hydrocyclone separator.

13. The process as claimed in claim 8, wherein spent clay is separated by employing a filter press.

14. A process for removal of contaminant metals from oils/fats comprising;

treating the oils/fats with phosphoric acid and citric acid, thereby obtaining a reaction produce;

treating the reaction product with clay in one or more stages and then with ion exchange resin to bring down a metal content below 1 ppm, wherein:

said phosphoric acid is present in the range of 0.01 to 0.10 wt % and said citric acid is present in the range of 0.01 to 0.10 wt %, the wt % being with respect to the oils/fats.

15. The process as claimed in claim 14, wherein the ion exchange resin is selected from one or more of:

matrix of styrene;

cross linked polystyrene;

cross linked polyacrylic; and cross linked polymethacrylic resin.

16. The process as claimed in claim 14, wherein the ion exchange resin is in the form of gel, is macroporous or is isoporous.

17. The process as claimed in claim 14, wherein ion exchange treatment is carried out using two or more beds of ion exchange resin being operated in swing mode of demetallation and regeneration.

18. The process as claimed in claim 17, further comprising regeneration of ion exchange resin, which is carried out by circulation of an alcohol and dilute solution of an inorganic acid.

19. The process as claimed in claim 14, wherein the oils/fats comprise at least one of vegetable oil, animal oils and fat.

20. The process as claimed in claim 19, wherein:

if the oils/fats comprise vegetable oil, the vegetable oil is selected from one or more of jatropha carcass oil, karanj oil, caster oil, ricebran oil, soybean oil, sunflower oil, palm oil, rapeseed oil; and if the oils fats comprise animal oil or fat, said animal oil or fat is selected from one or more of fish oil or lard.

21. The process as claimed in claim 1, wherein the metals include P, Na, K, Ca, Mg, Cu, Zn, Mn and Fe or any other metal contaminant.

22. The process as claimed in claim 3, wherein the amount of phosphoric acid used is in the range of 0.03 to 0.05 wt % with respect to the vegetable oils/animal oils/fats.

23. The process as claimed in claim 4, wherein the amount of citric acid used is in the range of 0.02 to 0.04 wt % with respect to the vegetable oils/animal oils/fats.

24. The process as claimed in claim 18, wherein the alcohol is isopropyl alcohol.

25. The process as claimed in claim 18, wherein the inorganic acid is hydrochloric acid.

* * * * *